US010926395B2

(12) United States Patent
Chijoff

(10) Patent No.: US 10,926,395 B2
(45) Date of Patent: Feb. 23, 2021

(54) MULTITOOL

(71) Applicant: Michael Chijoff, Kensington (AU)

(72) Inventor: Michael Chijoff, Kensington (AU)

( * ) Notice: Subject to any disclaimer, the term of this patent is extended or adjusted under 35 U.S.C. 154(b) by 59 days.

(21) Appl. No.: 15/729,820

(22) Filed: Oct. 11, 2017

(65) Prior Publication Data

US 2018/0099397 A1 Apr. 12, 2018

(30) Foreign Application Priority Data

Oct. 12, 2016 (AU) ..... 2016244226

(51) Int. Cl.

| | |
|---|---|
| ***B25B 13/00*** | (2006.01) |
| ***B25F 1/02*** | (2006.01) |
| ***B25F 1/00*** | (2006.01) |
| ***B25G 1/08*** | (2006.01) |
| ***B25B 23/12*** | (2006.01) |
| *B25B 13/46* | (2006.01) |

(52) U.S. Cl.

CPC ..... *B25F 1/02* (2013.01); *B25B 23/12* (2013.01); *B25F 1/003* (2013.01); *B25G 1/085* (2013.01); *B25B 13/46* (2013.01)

(58) Field of Classification Search

CPC ..... B25F 1/02; B25F 1/003; B25B 13/46
USPC ..... 7/138, 142, 164, 165, 167
See application file for complete search history.

(56) References Cited

U.S. PATENT DOCUMENTS

| | | | | |
|---|---|---|---|---|
| 5,280,659 | A * | 1/1994 | Park | B25F 1/003 7/107 |
| 8,621,961 | B2 * | 1/2014 | Burch | B25B 15/02 81/9.4 |
| D799,300 | S * | 10/2017 | Chang | B25F 1/04 D8/105 |
| 2005/0144730 | A1 * | 7/2005 | Barber | B25B 7/22 7/138 |
| 2014/0082850 | A1 * | 3/2014 | Stokes | H02G 1/005 7/108 |
| 2016/0008968 | A1 * | 1/2016 | Neubauer | B25B 15/005 7/138 |
| 2017/0066118 | A1 * | 3/2017 | Berman | B25F 1/04 |

* cited by examiner

*Primary Examiner* — Joseph J Hail
*Assistant Examiner* — Shantese L McDonald
(74) *Attorney, Agent, or Firm* — John A. Fortkort; Fortkort & Houston PC

(57) ABSTRACT

A multitool that can be carried on a person, including a body shaped to function as a series of tools, the body including a storage receptacle extending into the body from an opening at one end, the storage receptacle capable of receiving and retaining within the storage receptacle one or more hex drivers when not in use, the opening defining a socket formation for receiving and retaining a mounting end of a hex driver such that the hex driver protrudes from the body for use as a screwdriver.

16 Claims, 10 Drawing Sheets

MULTITOOL

FIELD OF THE INVENTION

The present invention relates to a multitool that contains a number of functions and is small enough to be carried on your person.

BACKGROUND OF THE INVENTION

There are many tools that exist that perform a number of functions within the one tool. A well-known version of this is called the Swiss Army knife. These types of tools are known as multitools.

Typically the tools are combined together around a single pivot point which allow the user to individually select the tool they require, rotate to position and use. These types of multitools can be carried but also can be heavy and bulky. The user is also unable to change/customise/add to the tools.

An alternate type of multitool comes in the form of a flat perforated metal sheet. These are known as credit card multitools due to them being the approximate size of a credit card. These tools perform a variety of functions but are typically stored within the person's wallet. Although they are light they are unable to store standard hex drivers due to their slim nature.

Another type of multitool comes in the form of a pocket tool. These are typically machined from a metal and contain a number of functions. Typically they have the ability to carry a standard ¼" hex driver on their body. These do allow the user to change the type of driver and are retained via the use of o-rings. Typically the only way these types of drivers can be used is via a hexagonal cutout. The driver is inserted and the user is required to apply downward pressure on the rear of the driver during use to ensure it does not slide out. This makes the driving action awkward for the user and reduces the amount of pressure able to be exerted onto the head of the nut/screw by the driver.

Typically multitools are made from a combination of metal and polymer, where the working elements/tools are typically metal. This results in increased costs for the product, through additional components and/or manufacturing processes required.

It is a desired object of the present invention to provide a portable multitool for day to day tasks that at least in part overcomes one or more of the above problems.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

According to a first aspect of the present invention, there is provided a multitool that can be carried on a person, including a body shaped to function as a series of tools, the body including a storage receptacle extending into the body from an opening at one end, the storage receptacle capable of receiving and retaining within the storage receptacle one or more hex drivers when not in use, the opening defining a socket for receiving and retaining a mounting end of a hex driver such that the hex driver protrudes from the body for use as a screwdriver.

Advantageously the storage receptacle comprises a shaft. The shaft can have a 0° draft angle. The shaft is hexagonal in shape to correspond with the mounting end of a hex driver. There may be provided a minimal tolerance fit between the shaft and the mounting end, for example a 0.2 mm tolerance.

Preferably there is provided a releasable locking mechanism including a protrusion within the storage receptacle that prevents the hex drivers from sliding out of the opening at the end of the receptacle. The protrusion may be moved between an engaged position and a released position via an actuator that is actuated from the outside of the body.

The storage receptacle is preferable of a length to store two hex drivers, such that two different hex drivers can be provided, for example a Phillips head screw driver and a flat head screw driver.

The locking mechanism, when in an engaged position can divide the receptacle from the pocket. The locking mechanism may therefore form an end wall of the socket, preventing the hex driver from sliding into the receptacle and forming the wall against which the hex driver is pushed in use. The wall of the locking mechanism can include a magnet to hold the hex driver in the socket. Alternatively, the wall of the socket may include a magnet to hold the hex driver in the socket.

The body is preferably generally scalene triangular in shape, with rounded corners, and having a relatively narrow depth such that it is generally flat. A large opening is preferably cut out from the centre region of the body towards one side, being the side opposite to the side along which the storage receptacle extends. The opening can be generally L-shaped, having a leg section and a foot section, the leg section being longer than the foot section. The leg section and foot section may be separated by a metal insert. The metal insert can be overmoulded by another material so that the metal does not come into contact with a flat surface onto which the multitool sits.

The leg section preferably includes a substantially straight portion that may function as a ruler. The opposite side of the leg section may be stepped, such that the distance between the two sides of the leg section increased along the length. The face of each of the steps and the face of the ruler are generally parallel. The steps may form a series of torque wrenches that may engage with a plurality of hexagonal nuts.

The foot section can be shaped to function as a bottle opener, having a straight section to engage underneath a bottle top for levering the bottle top.

The body may also include a hexagonal aperture that may function as a torque socket.

On an external side of the body there may be provided a protrusion with a curved claw section that functions as a box cutter.

The opening enables the carrying of the multitool on a key ring.

The multitool is preferably made from a polymer composite material, for example Nylon. An example of a preferred material is Polyamide 66+PA 6I/X. There may be a metal insert that is overmoulded by the polymer composite material. The metal insert may form the edges of the torque wrenches and/or an edge of the bottle opener.

In an embodiment, an additional tool set may be clipped onto the multitool. The tool set may be a pair of bicycle tyre levers for assisting in the removal of a bicycle tyre. The tyre levers can be shaped to clip together on opposite sides of the multitool body. Each tyre lever may have one or more magnets, which can join the tyre levers together through the cut-out in the centre region of the body. One or both of the tyre levers may contain a receptacle capable of storing additional hex drivers for use with the multitool.

In an embodiment, the socket may be a regular compound polygon, being a compound of two polygons, for example two overlaid hexagons with one rotated 30°, or two overlaid squares with one rotated 45°, or two overlaid pentagons with one rotated 36°. One polygon preferably corresponds to the shaft and the other rotated polygon only extends along the socket portion of the shaft, such that the mounting end of the hex driver may be inserted in a first orientation and engage in the shaft and slide into the storage receptacle, whereby rotation of the hex driver to engage the other rotated socket shape prevents full insertion into the storage receptacle.

In an embodiment, the socket can be a star figure in shape, being a compound of two hexagons. One hexagon corresponds to the hexagonal shaft and the other only extends along the socket portion of the shaft. As such the hexagonal mounting end of the hex driver may be inserted in a first orientation and engage in the hexagonal shaft and slides into the storage receptacle. Rotation of the hex driver to engage the other socket hexagonal shape prevents full insertion into the storage receptacle.

In an embodiment, the tolerance fit of the socket hexagonal shape can be less than the shaft, for example a 0.1 mm tolerance, such that the hex driver is held by friction within the socket in the correct orientation. The angle of rotation required is 30° to move the hex driver from an orientation for insertion into the storage receptacle and an orientation for being held in the socket for use.

Further aspects of the present invention and further embodiments of the aspects described in the preceding paragraphs will become apparent from the following description, given by way of example and with reference to the accompanying drawings.

DETAILED DESCRIPTION OF THE EMBODIMENTS

Figure 1:
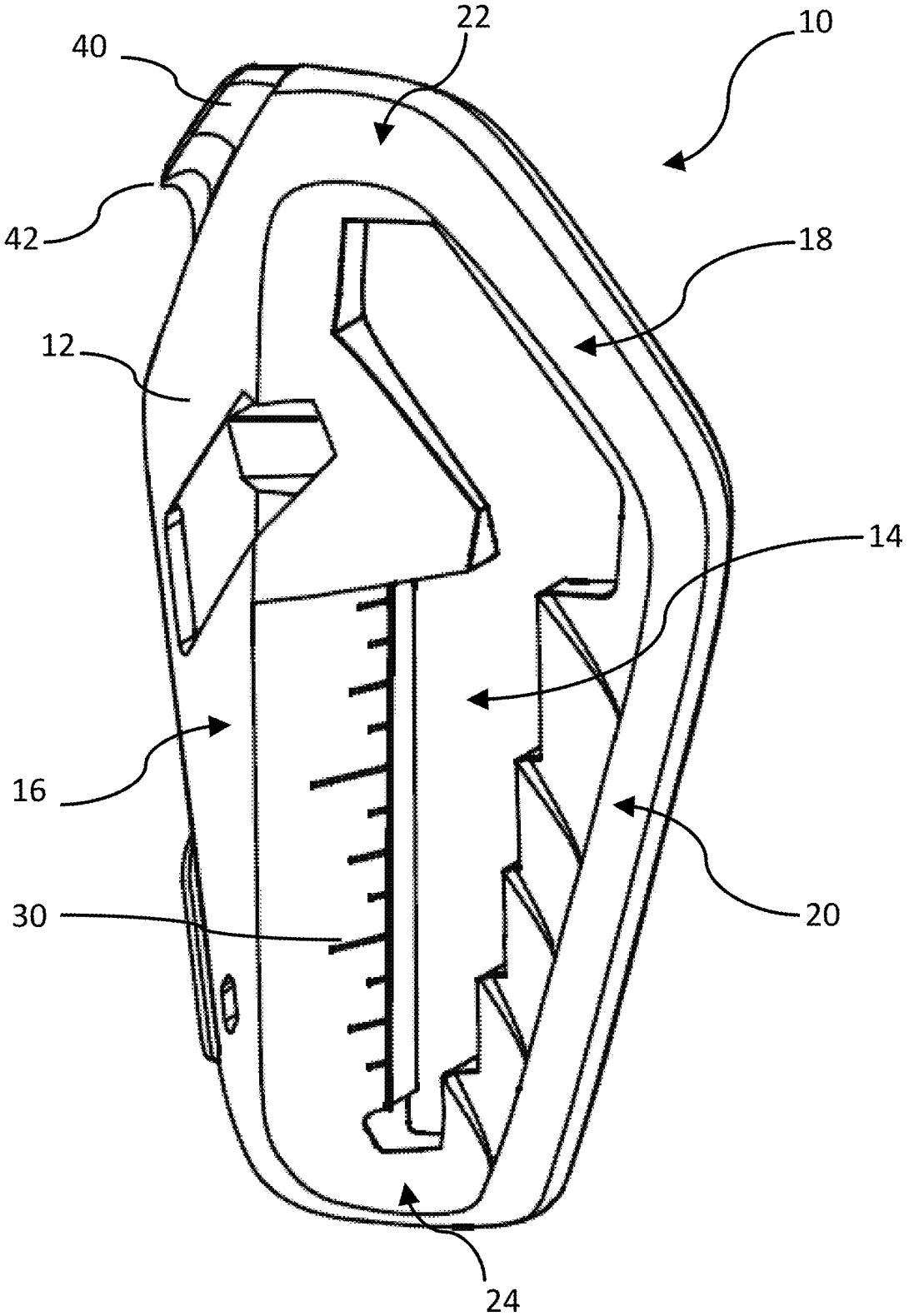
FIG. 1 shows a front perspective view of a multitool according to a first embodiment of the present invention.
Figure 2:
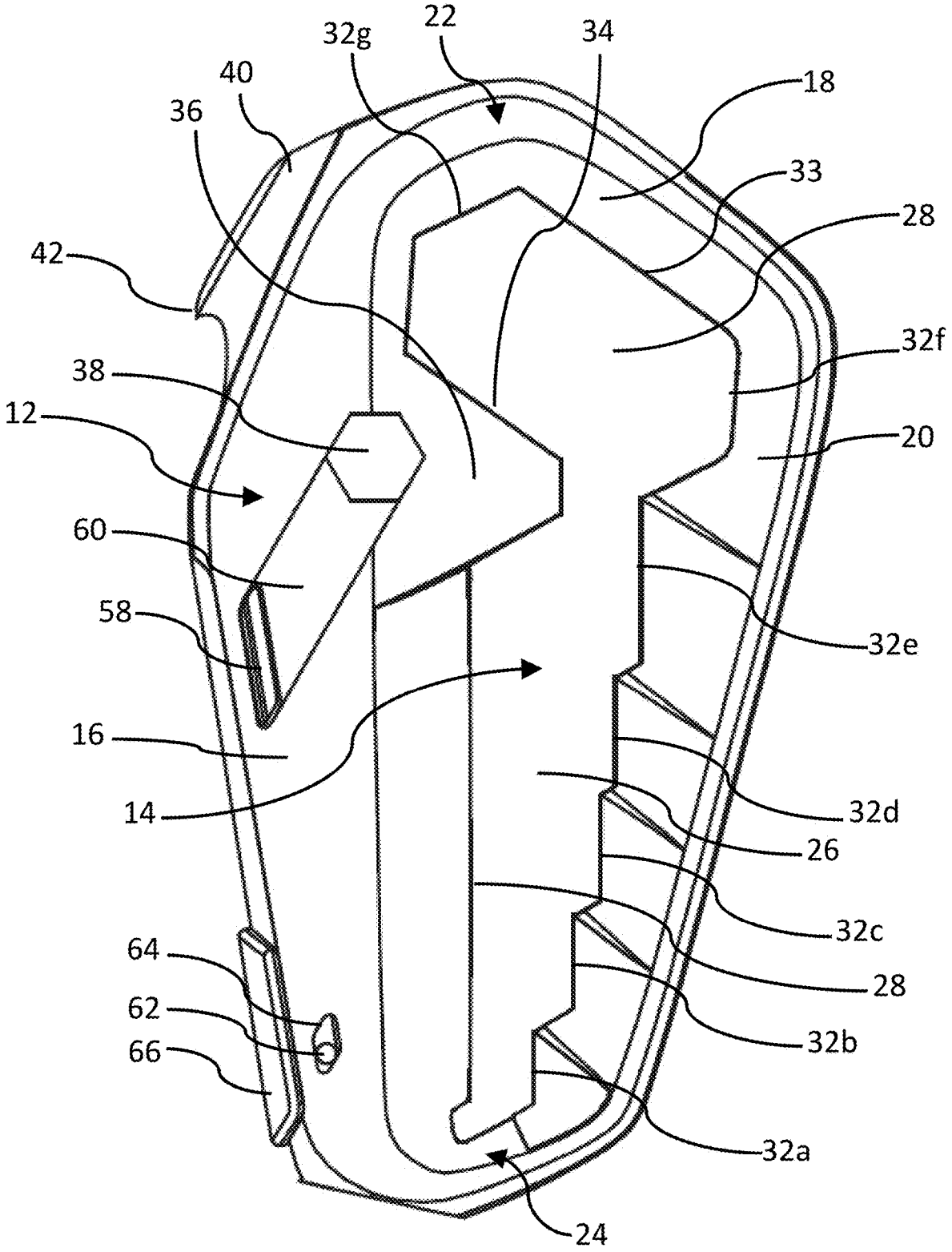
FIG. 2 shows a front view of the multitool of FIG. 1.

FIG. 1 shows a multitool 10 according to a first embodiment that is small enough to be carried on a person, such as in a pocket. The body 12 is generally planar, such that it has a relatively small depth and is therefore quite slim for placing in a pocket. The body is generally shaped like a scalene triangle, with rounded corners such that it is somewhat egg-oval in shape, such that the upper section is wider than the lower section. A large opening 14 is cut out from the centre region of the body. In reference to the orientation shown in FIGS. 1 and 2, the body defines a generally upright section 16 to the left of the opening 14. The right side of the opening is defined by two angled sections 18, 20. The ends of the angled sections 18, 20 are joined to the upright section 16 by curved sections 22, 24, respectively.

In this embodiment, the opening 14 is generally L-shaped, having a leg section 26 and a foot section 28. Along one side of the leg section 26 is a straight edge 28 that forms a ruler. The ruler section is wedged shaped in cross section, such that it slopes down from the upright section into the opening 14 and edge 28. Notches 30 may be provided to indicate incremental length measurements. Alternatively, the incremental markings may be provided by applying paint.

On the side of the leg section 26, being the inside surface of angled section 20, the edge 32 is stepped, such that, due to the steps and the angle of section 20, the distance between the ruler edge 28 and each step edge 32*a*-32*d* differs. The step edges 32*a*-32*e* are parallel with the ruler edge 28 and are set at distances corresponding to the below torque wrench sizes shown in FIG. 1. Further torque wrenches are formed at edge 32*f* at the heel of the leg and at edge 32*g* at the toe of the foot, with an opposing edge 34.

FIG. 1: Torque wrench sizes

| | |
|---|---|
| 32a | 5 mm - 3/16" |
| 32b | 8 mm - 5/16" |
| 32c | 10 mm - 3/8" |
| 32d | 11 mm - 7/16" |
| 32e | 13 mm - 1/2" |
| 32f | 15 mm - 5/8" |
| 32g | 14 mm - 9/16" |

The opposing edge 34 is a formed from a protrusion 36 extending into the opening 14 from the upright section 16. The edge 34, together with parallel edge 33 create a bottle opener, by placing the foot section 28 over a bottle lid, with the edge 34 under the lid to leverage it off the bottle.

Also provided in the body is a hexagonal aperture 38 that may be used as a torque socket.

On the outside of the body 12, there is provided a protrusion 40 with a curved claw section 42, which is shaped to resembles a talon. The claw 42 functions as a box cutter.

The body of the multitool is injection moulded primarily from a polymer composite material, for example Nylon. A preferred material is Polyamide 66+PA 6I/X, with a 70% glass fill by weight. This material is very strong, with a high lateral stiffness, whilst being lightweight and providing very little warpage or shrinkage during moulding. This material is unlikely to scratch surfaces if placed in a pocket or bag with other items such as a phone.

Figure 3:
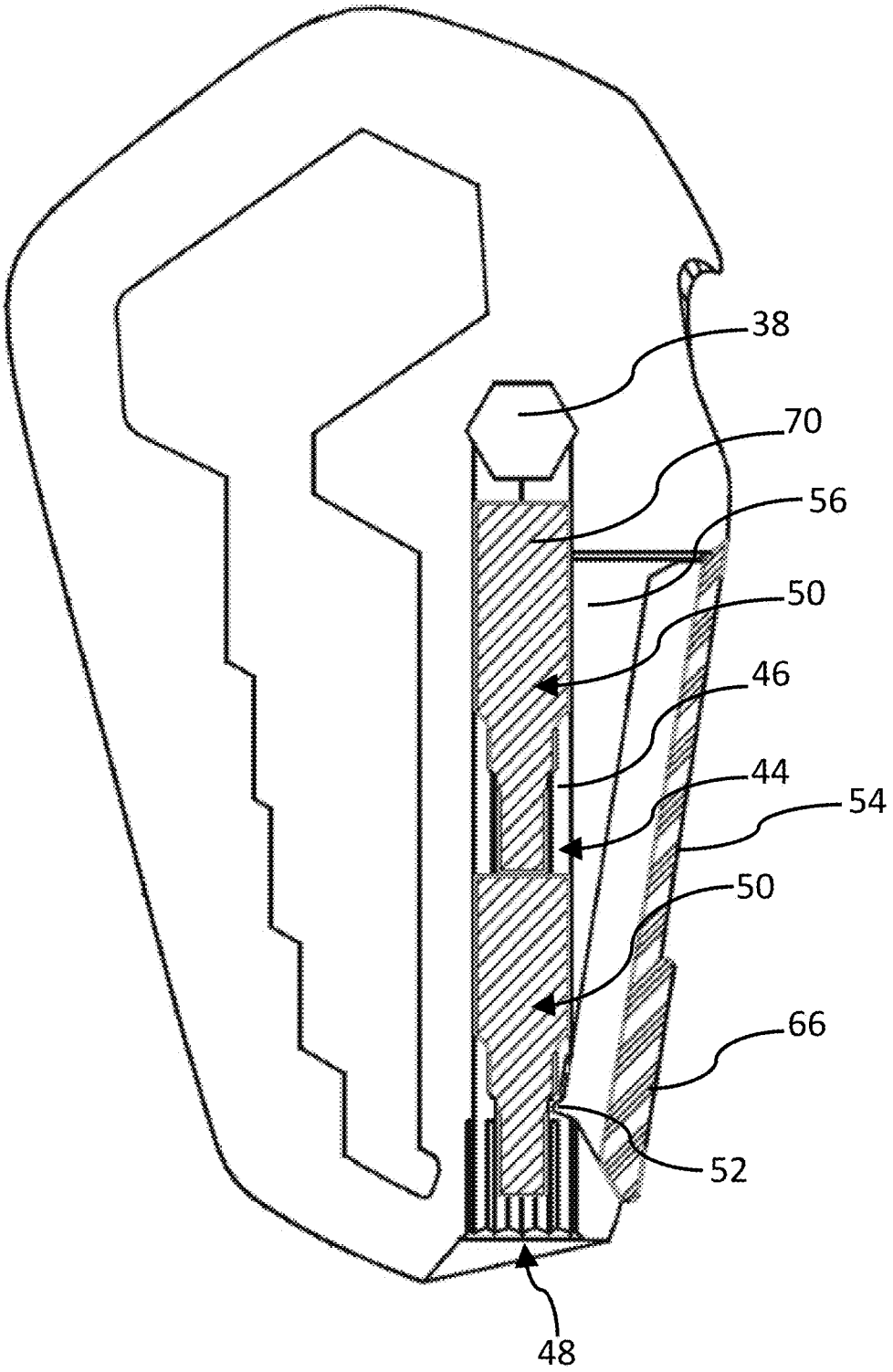
FIG. 3 shows a cross-sectional front view of FIG. 2.
Figure 4:
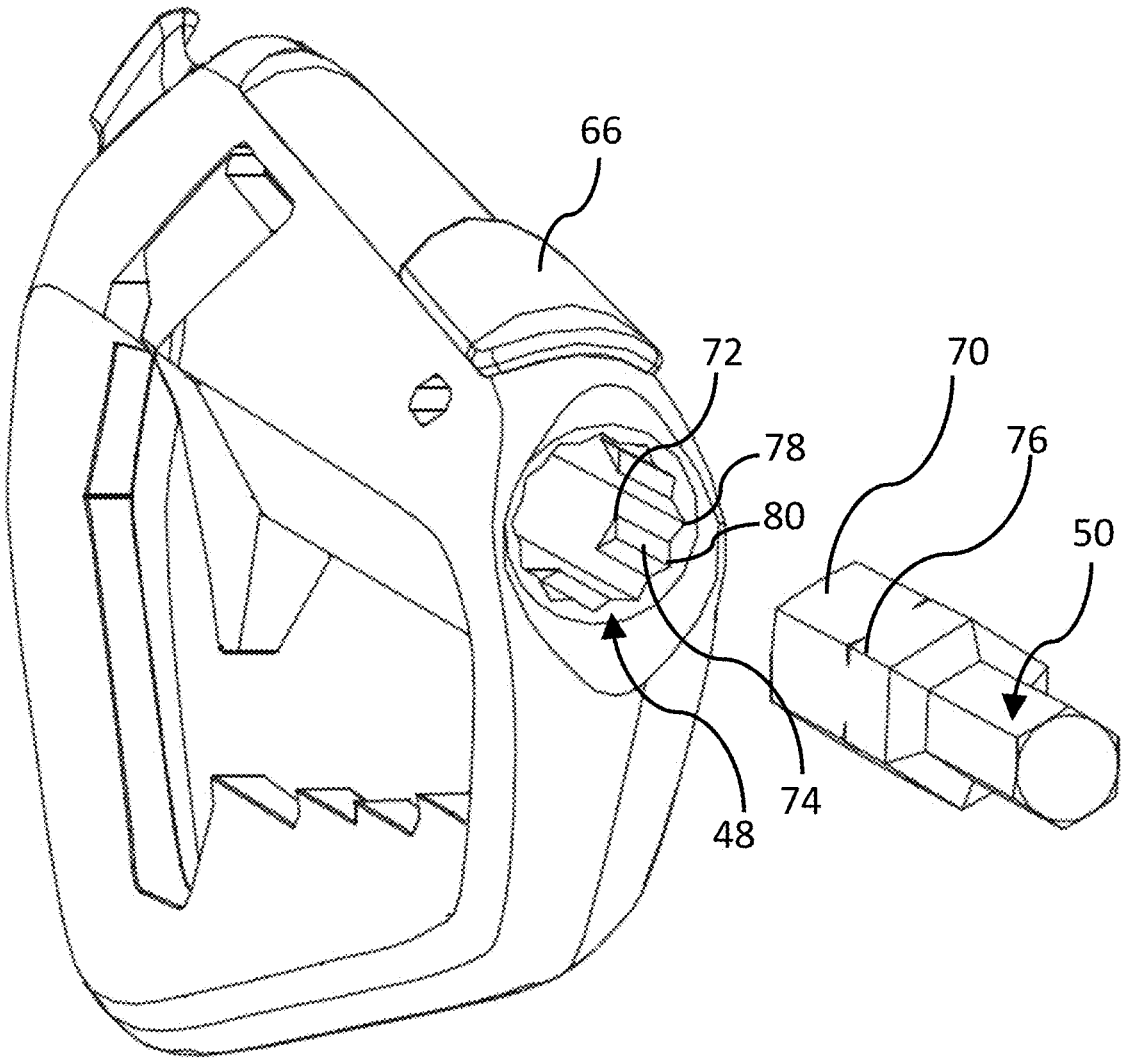
FIG. 4 shows an end perspective view of the multitool of FIG. 1 with a hex head being inserted.

Within the upright section 16 there is a storage receptacle 44 comprising a shaft 46 that extends from an opening 48 into the upright section of the body. The shaft is sized to receive one or two hex drivers 50 for storage. FIG. 3 shows a cross sectional view with two hex drivers 50 in a storage position. Due to material selection, the draft angle on the shaft can be 0° or close thereto and the tolerance can be minimal, such as 0.2 mm to allow the hex drivers to slide within the shaft.

Figure 6:
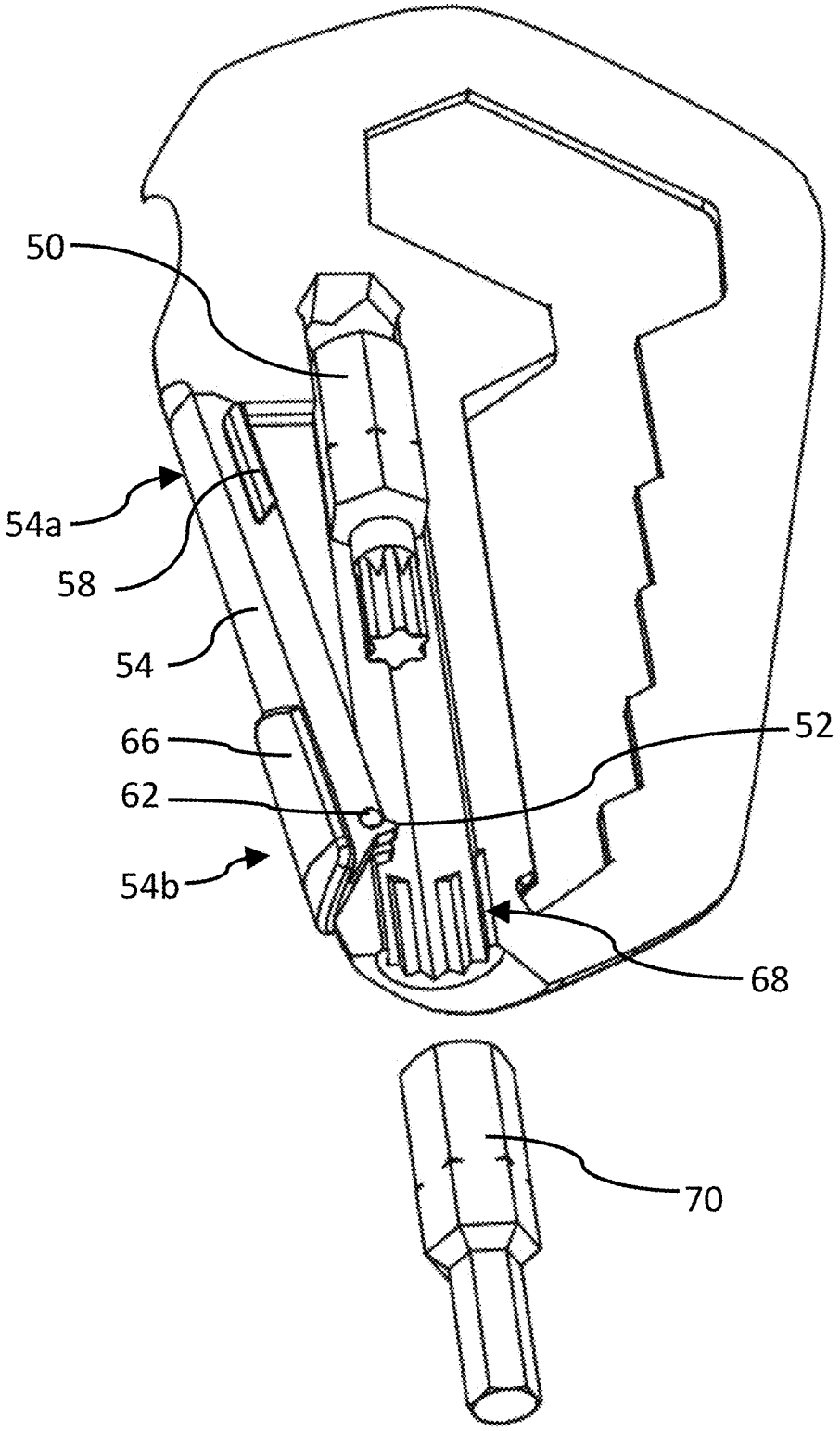
FIG. 6 shows a cross-sections perspective front view of the multitool of FIG. 1 with a hex head being inserted and another hex head stored inside.
Figure 7A:
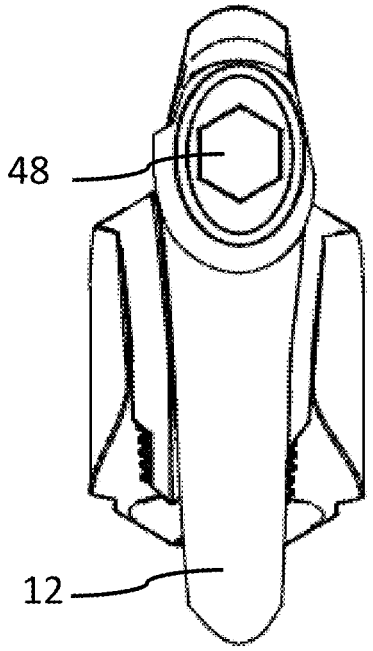
FIG. 7*a* shows an end view of the socket opening of a multitool according to a second embodiment of the present invention.
Figure 7B:
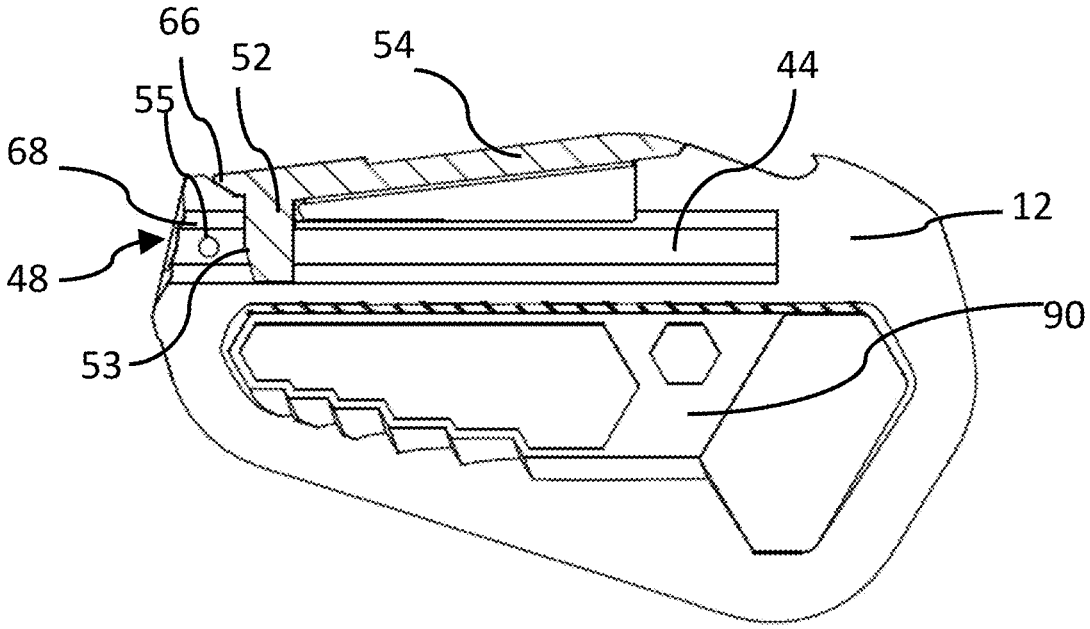
FIG. 7*b* shows a cross-sectional side view through the socket and receptacle of the multitool according to the second embodiment.

The hex drivers 50 are held within the shaft 46 by a releasable locking mechanism, which includes a protrusion 52 that projects into the shaft. The protrusion prevents the hex drivers from sliding past and out of the opening 48. The protrusion 52 is on the end of an arm 54. The arm 54 is housed within a slot 56 formed in the upright section 16. The arm 54 is made from a different material to the body 12, such that it is provided with the ability to flex. Such material may be a type of rubber. The rear end 54*a* of the arm is joined to the body by flanges 58 extending outwardly from both sides (see FIG. 6). The flanges 58 slot into openings 60 in the body (see FIG. 2). The front end 54*b* of the arm includes two lateral dimples 62 that slot into openings 64 in the body. An actuator portion 66 on the front end can be lifted outwardly disengaging the dimples 62 from the openings 64 to pull the protrusions 52 out of the shaft 46, allowing the hex drivers 50 to slide out. To re-engage the locking mechanism, the actuator portion 66 can be pushed back into the slot 56 inserting the dimples 62 into the openings 64.

The shaft 56 and the mounting end 70 of the hex drivers 50 are of corresponding shape, being a polygon, for example a hexagon shape as shown in the drawings, having six sides. Therefore, for the hex driver 50 to slide into the shaft 56 for storage, it must be inserted into the opening 48 in one of six rotational orientations such that the hexagon of the mounting end 70 lines up with the hexagon of the shaft 56.

The opening 48 of the shaft 56 defines a socket portion 68 for receiving and retaining a hex driver during use, such that it projects from the multitool for use as a screwdriver.

Figure 5A:
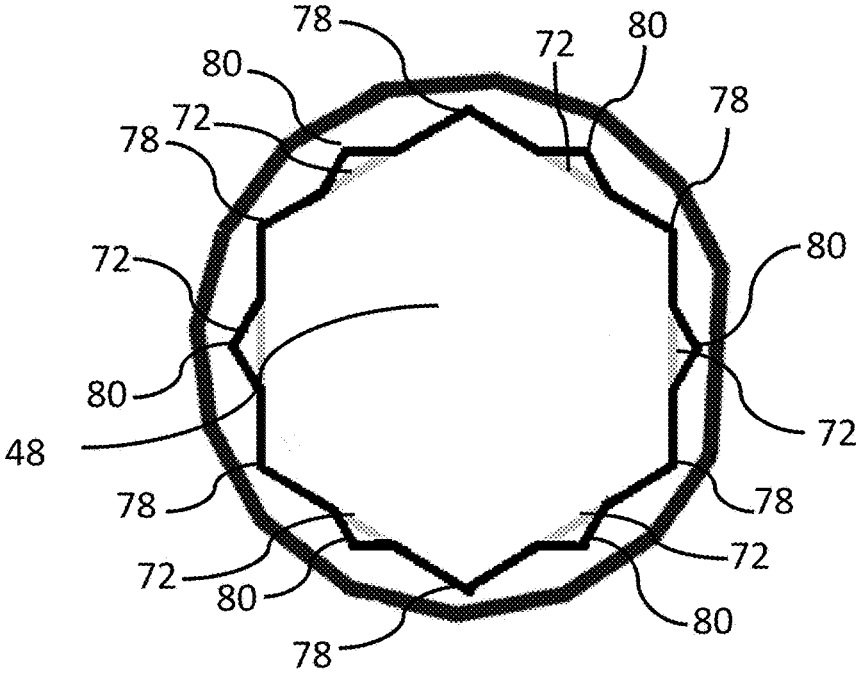
FIG. 5*a* shows a representative end view of the socket opening of the first embodiment.
Figure 5B:
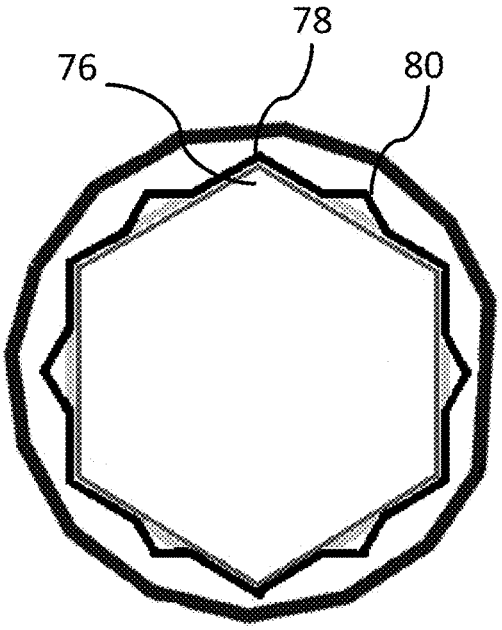
FIG. 5*b* shows a representative end view of the socket opening of FIG. 5*a* with a hex head being inserted in a first orientation.
Figure 5C:
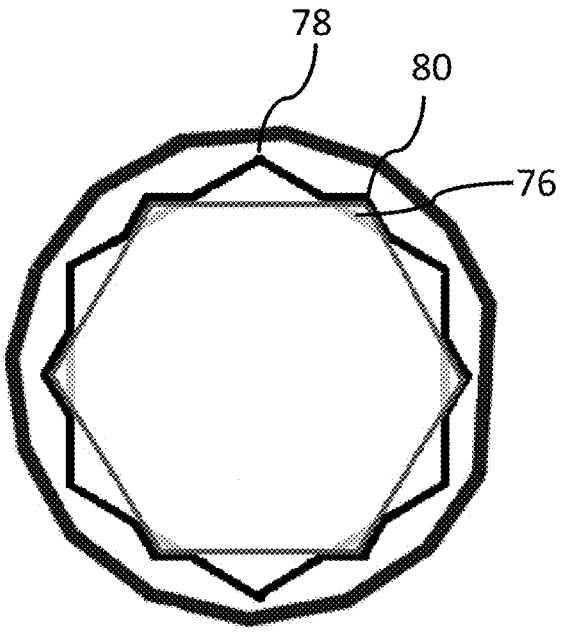
FIG. 5*c* shows a representative end view of the socket opening of FIG. 5*a* with a hex head being inserted in a second orientation.

In the embodiment illustrated in FIGS. 1 to 6, the socket portion 68 is a regular compound polygon, or a regular star polygon star figure (compound), being a compound of two overlaid hexagons with one rotated 30°, as shown in the representation in FIG. 5*a*. Along the length of the socket portion, a dodecagram star figure is formed, having 12 points. At the bottom of the socket portion, the rotated hexagon stops forming shoulders 72 at the end of cut outs 74. What this means is that in a first orientation, as shown in FIG. 5*b*, the points 76 of the mounting end 70 line up with the points 78 of the shaft 56, such that the hex driver 50 can slide past the socket portion 68 into the receptacle for storage. To use it as a screwdriver, the hex driver is rotated 30° to a second orientation, as shown in FIG. 5*c*, and inserted into the socket portion 68. As the points 76 of the mounting end line up with the points 80 they slide into the socket portion, but cannot slide past the shoulders 72. The tolerance provided between the socket points 80 and the points 76 of the mounting end are such as to provide a friction fit for holding the hex driver 50 within the socket by friction. Such a tolerance may be around 0.1 mm. This small tolerance is able to be provided due to the 0° draft angle on the shaft as a result of the material selection.

A second embodiment of the invention is illustrated in FIGS. 7*a* to 11. In this embodiment, there are two major differences to the multitool shown in FIGS. 1 to 6. The first is the socket 68 for holding the hex driver in use. In this embodiment, the socket opening 48 matches the receptacle shaft 46 in shape i.e. a simple hexagon. Insertion of the hex driver 50 in any rotational orientation will result in the hex driver moving into the receptacle 44 if the locking mechanism is disengaged. As shown in FIG. 7*b*, the protrusion 52 of the locking mechanism is longer in this embodiment and blocks access into the receptacle. The protrusion forms an end wall 53 of the socket 68. When in use, the mounting end 70 of the hex driver would bear against the end wall 53 when the hex driver 50 is pushed against a screw to be tightened or untightened. The locking mechanism is otherwise similar to the first embodiment, being an arm 54 housed within a slot 56 formed in the upright section 16. The arm 54 is made from a type of rubber to allow it to flex. An actuator portion 66 on the front end can be lifted outwardly disengaging the dimples 62 from the openings 64 to pull the protrusions 52 out of the shaft 46, allowing the hex drivers 50 to slide out. To re-engage the locking mechanism, the actuator portion 66 can be pushed back into the slot 56 inserting the dimples 62 into the openings 64 and the protrusion 52 into the shaft.

A magnet 55 is provided in the side wall of the socket to hold the hex driver 50 in position when pressure is removed. If held with the opening facing downwards, the strength of the magnet is such that it catches the hex drivers as they move past the magnet and holds them so they don't fall straight out. A user can then remove them easily by pulling on the end out of the opening. Once the first hex driver is removed, the second hex driver drops into position and is again caught by the magnet. It will be appreciated that the magnet may be provided in the end wall 53 of the protrusion 52, however then the benefit of catching the hex drivers would be negated.

Figure 8:
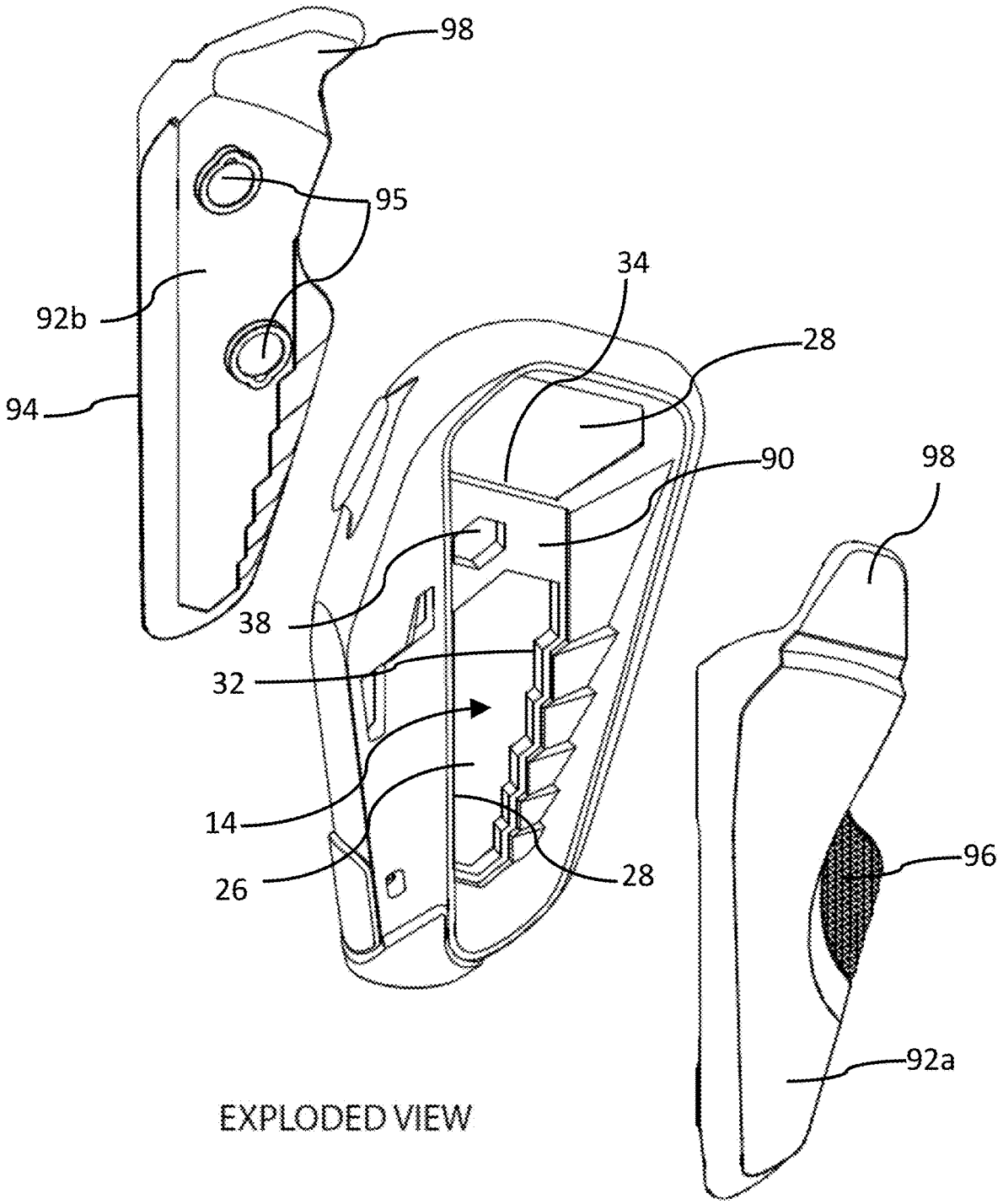
FIG. 8 shows a perspective view of the multitool of the second embodiment, with two tyre levers in an exploded configuration.

The second difference between the first and second embodiments is that, as shown in FIG. 8, the multitool includes a metal insert 90 that is overmoulded during manufacture with the polymer composite material to form an integral structure. The metal insert sits within the opening 14 in the centre region of the body 12, dividing the leg section 26 and a foot section 28 into two separate openings. The top of the metal insert creates the edge 34 of the bottle opener. The sides of the metal insert create the edges 32*a*-32*e* and the ruler edge 28 to create the torque wrenches. The hexagonal aperture 38 is formed in the metal insert. The metal insert provides a more durable surface to withstand longer repetitive use of the multitool, whilst still maintaining the overall lightness and non-scratching nature of the polymer composite material.

Figure 9:
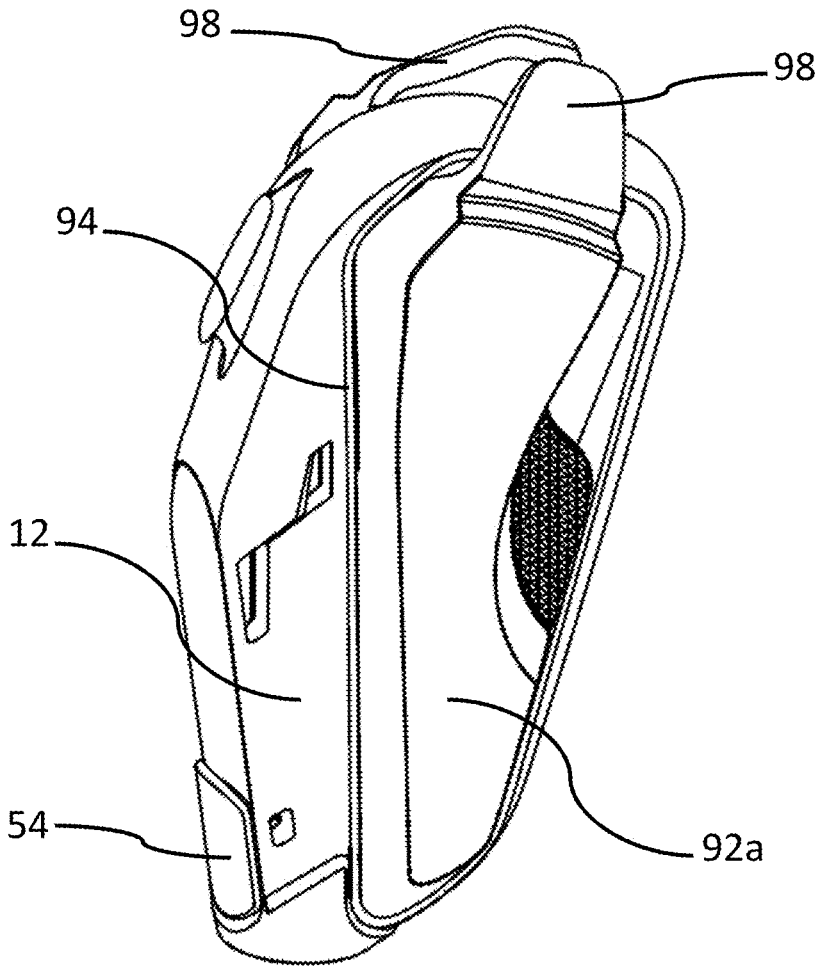
FIG. 9 shows a perspective view of the multitool of FIG. 7*a;*
Figure 10:
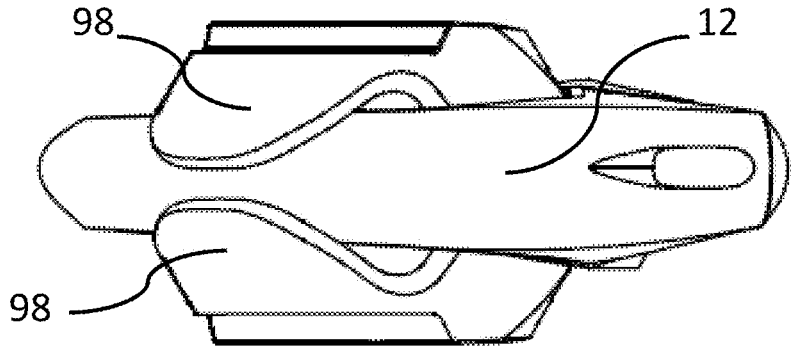
FIG. 10 shows a top view of the multitool of FIG. 7*a*.
Figure 11:
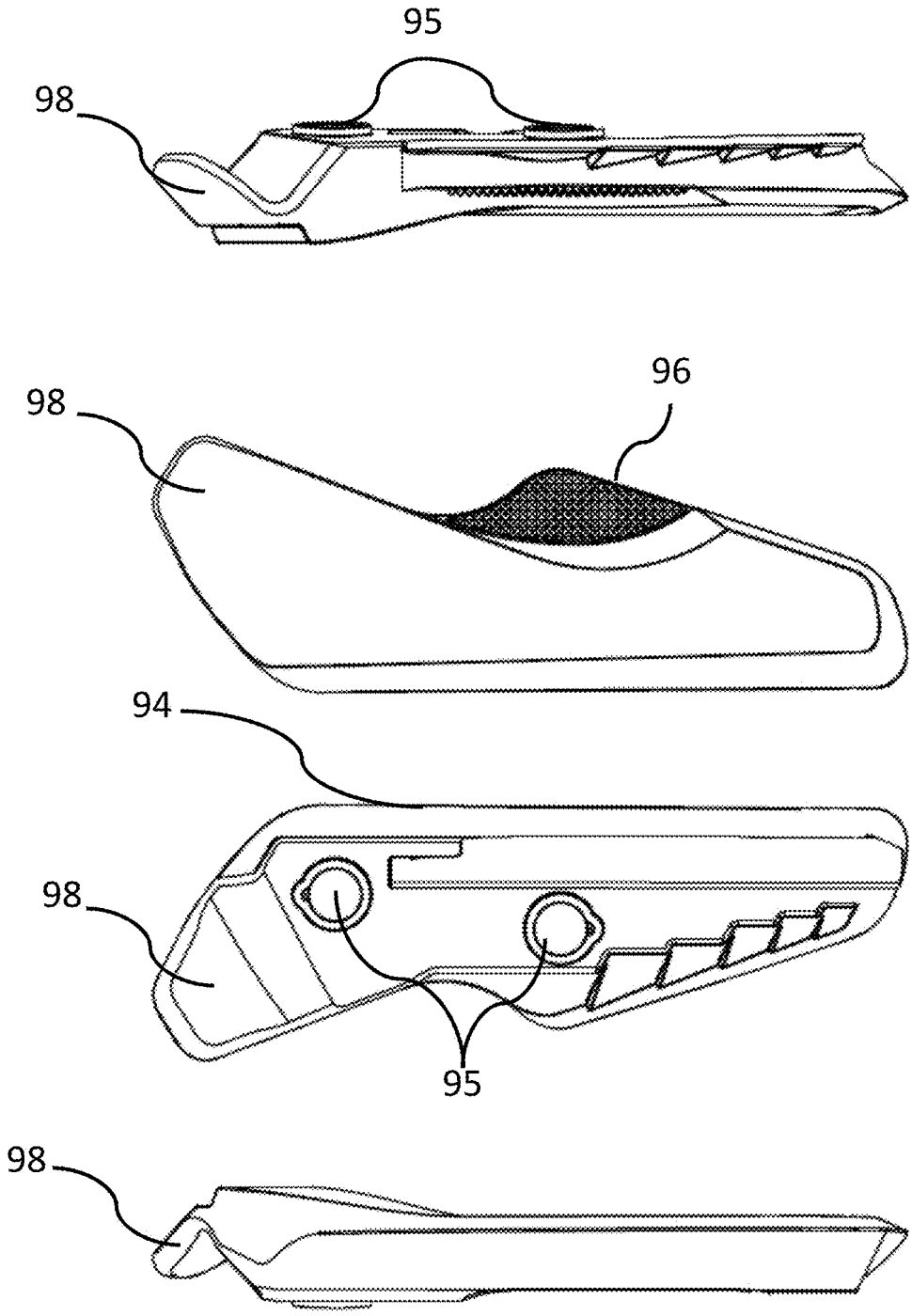
FIG. 11 shows side, front, back and other side views of the tyre levers.

An additional tool set is provided in the embodiment shown in FIGS. 7*a* to 11, which complements either embodiment of the multitool. A pair of tyre levers 92*a*, 92*b* are sized and shaped to partially nestle within the opening 14 in the centre region of the body 12. The tyre levers are generally elongate, having a generally straight edge 94 that corresponds to the ruler edge 28. The opposite side has a thumb depression 96 on the outside to assist the user and the inside is shaped to sit against the steps 32 of the torque wrenches. The upper end has the lever 98 that gets inserted under the tyre edge to pry the tyre off the wheel rim. The two tyre levers 92*a*, 92*b* are generally mirror images of each other, such that they nestle into opposite sides of the multitool body. The levers 98 extend over the top of the multitool partially wrapping around the top edge, as shown in FIGS. 9 and 10.

Two spaced apart magnets 95 are provided on the inside of the tyre levers to hold the opposing tyre levers 92*a*, 92*b* together through the central opening 14, with one pair of opposing magnets located in the leg section 26 and the other pair of opposing magnets located in the foot section 28.

One of the tyre levers 92*a* also includes a receptacle for holding additional hex drivers. The receptacle is an open sided shaft 97 that allows a finger to slide along the side to remove the hex drivers. A magnet may be provided inside the receptacle to hold the hex drivers in position. Alternatively, a locking mechanism may be provided at the open end 99 of the shaft 97 to prevent unwanted removal.

The advantages of the present invention are that you can carry two different hex drivers in the storage receptacle and as they are not permanently joined to the multitool they can be customised by the user. The moulding of the body such that it forms a number of tools, means that it is quick and easy to use and does not require these tools to be moved in and out of position. The material used allows for strength with minimal weight, whilst also minimising the scratching of other items in a user's pocket or bag.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A multitool that can be carried on a person, including a body shaped to function as a series of tools, the body including a storage receptacle extending into the body from an opening at one end, the storage receptacle capable of receiving and retaining within the storage receptacle one or more hex drivers when not in use, the opening defining a socket formation for receiving and retaining a mounting end of a hex driver such that the hex driver protrudes from the body for use as a screwdriver;

wherein the storage receptacle comprises a shaft that is shaped to correspond with the shape of the mounting end of the hex driver;

wherein there is provided a releasable locking mechanism including a protrusion within the storage receptacle that prevents the hex drivers from sliding out of the open end of the receptacle, and whereby the protrusion, in the engaged position, divides the receptacle from the socket.

2. A multitool according to claim 1, wherein the protrusion is movable between an engaged position and a released position via an actuator that is actuated from the outside of the body.

3. A multitool according to claim 2, wherein the locking mechanism is a flexible insert that can be moved between the engaged position and the released position by manually manipulating the actuator.

4. A multitool according to claim 1, wherein the protrusion forms an end wall of the socket.

5. A multitool according to claim 1, wherein a magnet is provided in the socket to hold the hex driver within the socket.

6. A multitool according to claim 1, wherein the storage receptacle is of a length to store two hex drivers, such that two different hex drivers can be provided.

7. A multitool according to claim 1, wherein the storage compartment has a 0° draft angle.

8. A multitool according to claim 1, whereby there is provided a tolerance fit between the shaft and the mounting end of the hex driver to allow the hex driver to slide within the shaft.

9. A multitool according to claim 1, whereby the body is formed to define at least a series of torque wrenches.

10. A multitool according to claim 1, whereby the body is formed to define at least a bottle opener.

11. A multitool according to claim 1, whereby the body is formed to define at least a box opener.

12. A multitool according to claim 1, whereby the body is formed to define at least a ruler.

13. A multitool according to claim 1, whereby the body is primarily made from a polymer composite material.

14. A multitool according to claim 13, wherein the polymer composite material is Polyamide 66+PA 6I/X.

15. A multitool according to claim 13, wherein a metal insert is provided that is overmoulded with the polymer composite material to form an integral body.

16. A multitool that can be carried on a person, including a body shaped to function as a series of tools, the body including a storage receptacle extending into the body from an opening at one end, the storage receptacle capable of receiving and retaining within the storage receptacle one or more hex drivers when not in use, the opening defining a socket formation for receiving and retaining a mounting end of a hex driver such that the hex driver protrudes from the body for use as a screwdriver;

wherein the storage receptacle comprises a shaft that is shaped to correspond with the shape of the mounting end of the hex driver; and wherein there is provided a releasable locking mechanism including a protrusion within the storage receptacle that prevents the hex drivers from sliding out of the open end of the receptacle, the protrusion forms an end wall of the socket.

* * * * *